US008061450B2

(12) United States Patent
Marshall

(10) Patent No.: US 8,061,450 B2
(45) Date of Patent: Nov. 22, 2011

(54) PERCUSSION DRILLING ASSEMBLY HAVING EROSION RETARDING CASING

(75) Inventor: Alan J. Marshall, Lost Creek, WV (US)

(73) Assignee: Smith International, Inc., Houston, TX (US)

( * ) Notice: Subject to any disclaimer, the term of this patent is extended or adjusted under 35 U.S.C. 154(b) by 97 days.

(21) Appl. No.: 12/194,047

(22) Filed: Aug. 19, 2008

(65) Prior Publication Data

US 2010/0044111 A1 Feb. 25, 2010

(51) Int. Cl.
*E21B 17/00* (2006.01)

(52) U.S. Cl. ..... 175/320; 175/296

(58) Field of Classification Search ..... 175/293, 175/296, 297, 320
See application file for complete search history.

(56) References Cited

U.S. PATENT DOCUMENTS 2,620,162 A * 12/1952 Pennington ..... 173/73
2,873,093 A * 2/1959 Hildebrandt et al. ..... 175/92
3,258,077 A * 6/1966 Phipps ..... 175/389
3,834,471 A * 9/1974 Bottoms ..... 175/304
5,154,244 A * 10/1992 Elsby et al. ..... 175/296
7,624,822 B2 * 12/2009 Olsson et al. ..... 175/293
2002/0043406 A1 * 4/2002 Wentworth et al. ..... 175/61
2006/0060388 A1 * 3/2006 Linden et al. ..... 175/414

OTHER PUBLICATIONS

Dictionary definitions of "Hole" "Dimple" and "Pit" from thefreedictionary.com, accessed Dec. 17, 2010.*

* cited by examiner

*Primary Examiner* — Kenneth L Thompson
*Assistant Examiner* — Blake Michener
(74) *Attorney, Agent, or Firm* — Osha • Liang LLP

(57) ABSTRACT

A percussion drilling assembly for drilling through earthen formations and forming a borehole. In some embodiments, the drilling assembly includes a retainer sleeve having an upper end with an outer diameter and a tubular casing engaging the retainer sleeve. The tubular casing includes a first, second, and third tubular portion. The first tubular portion engages the upper end of the retainer sleeve at a first end having an outer diameter substantially equal to the outer diameter of the retainer sleeve. The second tubular portion is connected to the first tubular portion at a first end and has a second end with an outer diameter that differs from the outer diameter of the retainer sleeve. The third tubular portion is coupled to the second tubular portion. The first and third tubular portions each have a length configured to enable gripping of the tubular casing using tongs.

19 Claims, 13 Drawing Sheets

PERCUSSION DRILLING ASSEMBLY HAVING EROSION RETARDING CASING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Art

The disclosure relates generally to earth boring bits used to drill a borehole for applications including the recovery of oil, gas or minerals, mining, blast holes, water wells and construction projects. More particularly, the disclosure relates to percussion hammer drill bits. Still more particularly, the disclosure relates to percussion hammer drill bits with an erosion retarding case.

2. Background of Related Art

In percussion or hammer drilling operations, a drill bit mounted to the lower end of a drill string simultaneously rotates and impacts the earth in a cyclic fashion to crush, break, and loosen formation material. In such operations, the mechanism for penetrating the earthen formation is of an impacting nature, rather than shearing. The impacting and rotating hammer bit engages the earthen formation and proceeds to form a borehole along a predetermined path toward a target zone. The borehole created will have a diameter generally equal to the diameter or "gage" of the drill bit.

A typical percussion drilling assembly is connected to the lower end of a rotatable drill string and includes a downhole piston-cylinder assembly coupled to the hammer bit. The impact force is generated by the downhole piston-cylinder assembly and transferred to the hammer bit via a driver sub. During drilling operations, a pressurized or compressed fluid (e.g., compressed air) flows down the drill string to the percussion drilling assembly. A choke is provided to regulate the flow of the compressed fluid to the piston-cylinder assembly and the hammer bit. A fraction of the compressed fluid flows through a series of ports and passages to the piston-cylinder assembly, thereby actuating the reciprocal motion of the piston, and then is exhausted through a series of passages in the hammer bit body to the bit face. The remaining portion of the compressed fluid flows through the choke and into the series of passages in the hammer bit body to the bit face. The compressed fluid exiting the bit face serves to flush cuttings away from the bit face to the surface through the annulus between the drill string and the borehole sidewall.

The hammer bit body may be generally described as cylindrical in shape and includes a radially outer skirt surface aligned with or slightly recessed from the borehole sidewall and a bottomhole facing cutting face. The earth disintegrating action of the hammer bit is enhanced by providing a plurality of cutting elements that extend from the cutting face of the bit for engaging and breaking up the formation. To promote efficient penetration by the hammer bit, the bit is "indexed" to fresh earthen formations for each subsequent impact. Indexing is achieved by rotating the hammer bit a slight amount between each impact of the bit with the earth. During drilling operations with the hammer bit, the borehole is formed as the impact and indexing of the drill bit, and thus cutting elements, break off chips of formation material which are continuously cleared from the bit path by pressurized air pumped downwardly through ports in the face of the bit.

In oil and gas drilling, the cost of drilling a borehole is very high, and is proportional to the length of time it takes to drill to the desired depth and location. The time required to drill the well, in turn, is greatly affected by the number of times the drill bit, or other component of the percussion drilling assembly, must be changed before reaching the targeted formation. Each time a drilling assembly component is changed, the entire string of drill pipe, which may be miles long, must be retrieved from the borehole, section by section. Once the drill string has been retrieved and the new component installed, the drilling assembly must be lowered to the bottom of the borehole on the drill string, which again must be constructed section by section. As is thus obvious, this process, known as a "trip" of the drill string, requires considerable time, effort and expense.

Some conventional percussion drilling assemblies include a top sub coupled to the lower end of a drill string, a driver sub, a tubular case axially disposed between the top sub and driver sub, a hammer bit received by the driver sub, and a bit retainer engaging the lower end of the driver sub. During drilling operations, chips of formation material cleared from the bit path by pressurized air pumped downwardly through ports in the face of the bit are carried by the pressurized air from the borehole upward through the annulus between the drilling assembly and the borehole sidewall to the surface. Due to geometric differences between the outer surfaces of the drill bit, bit retainer and case, localized turbulent fluid flow develops adjacent the lower end of the case. The combined effect of the turbulent fluid flow and the chips of abrasive formation material suspended therein causes erosion of the case outer surface in this portion. Over time, erosion of the case weakens the case and hastens the need for replacement of the case. As described above, replacement of the case is a time consuming and costly procedure.

Accordingly, there is a need for a case for percussion drilling assemblies and hammer bits that prolongs the service life of the drilling assembly and thus postpones the need for its replacement.

SUMMARY OF THE DISCLOSED EMBODIMENTS

A percussion drilling assembly for drilling through earthen formations and forming a borehole is disclosed. The drilling assembly includes a retainer sleeve having an upper end with an outer diameter and a tubular casing engaging the retainer sleeve. In some embodiments, the tubular casing includes a first tubular portion, a second tubular portion, and a third tubular portion. The first tubular portion engages the upper end of the retainer sleeve at a first end having an outer diameter substantially equal to the outer diameter of the retainer sleeve. The second tubular portion is connected to the first tubular portion at a first end and has a second end with an outer diameter that differs from the outer diameter of the retainer sleeve. The third tubular portion is coupled to the second tubular portion. The first tubular portion and the third tubular portion each have a length configured to enable gripping of the tubular casing over at least one of the first tubular portion and the third tubular portion using tongs.

In some embodiments, the tubular casing includes a first tubular segment, a second tubular segment, and a third tubular segment. The first tubular segment engages the upper end of the retainer sleeve at a first end having an outer diameter substantially equal to the outer diameter of the retainer sleeve. The second tubular segment is connected to the first tubular segment at a first end and has a second end. The third tubular segment is connected to the second end of the second tubular segment.

In some embodiments, the tubular casing includes a first end in engagement with the retainer sleeve and a textured outer surface having one or more recesses formed therein. The first end has an outer diameter substantially equal to the outer diameter of the retainer sleeve.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
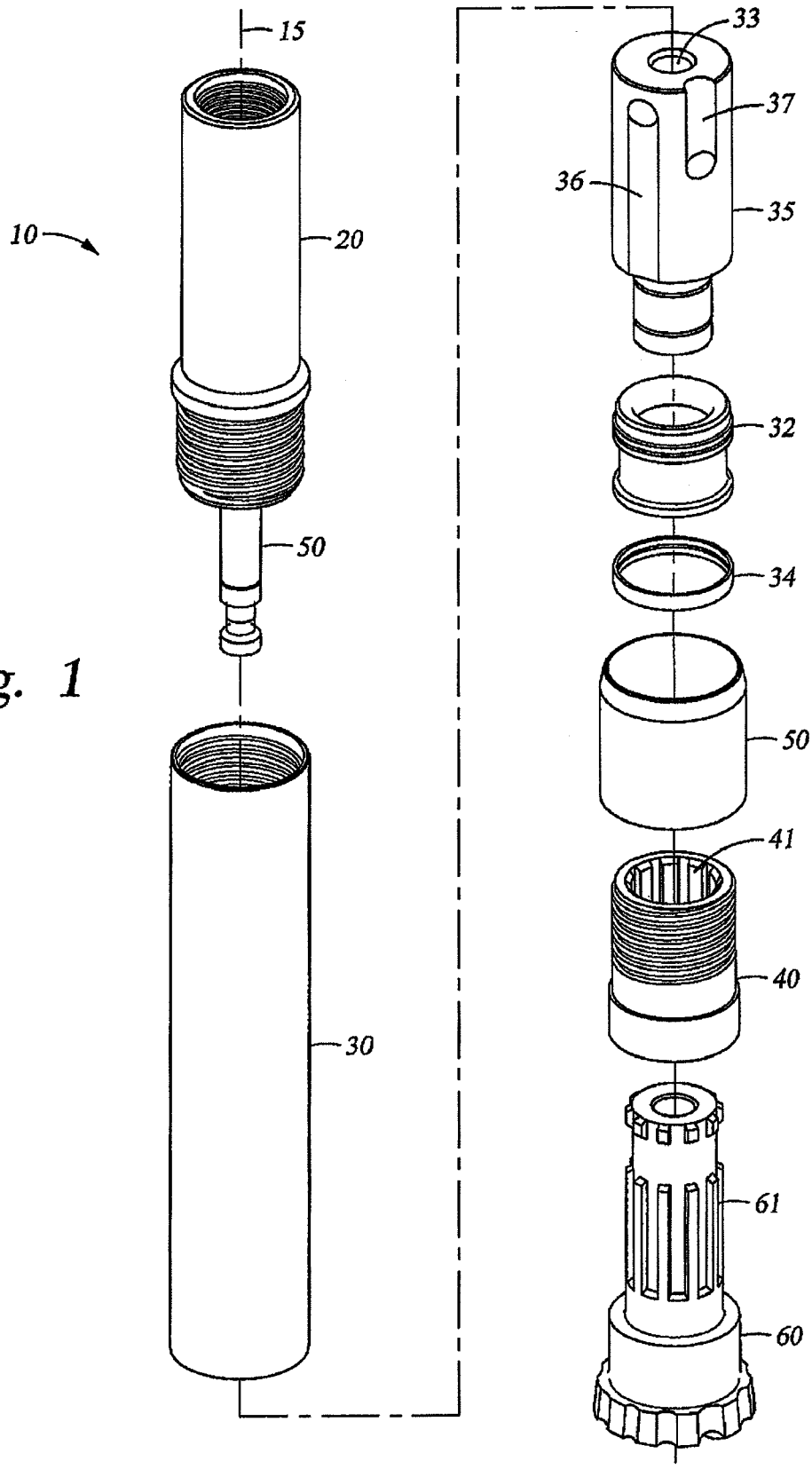
FIG. 1 is an exploded perspective view of a percussion drilling assembly including an erosion retarding case made in accordance with the disclosure herein.
Figure 2:
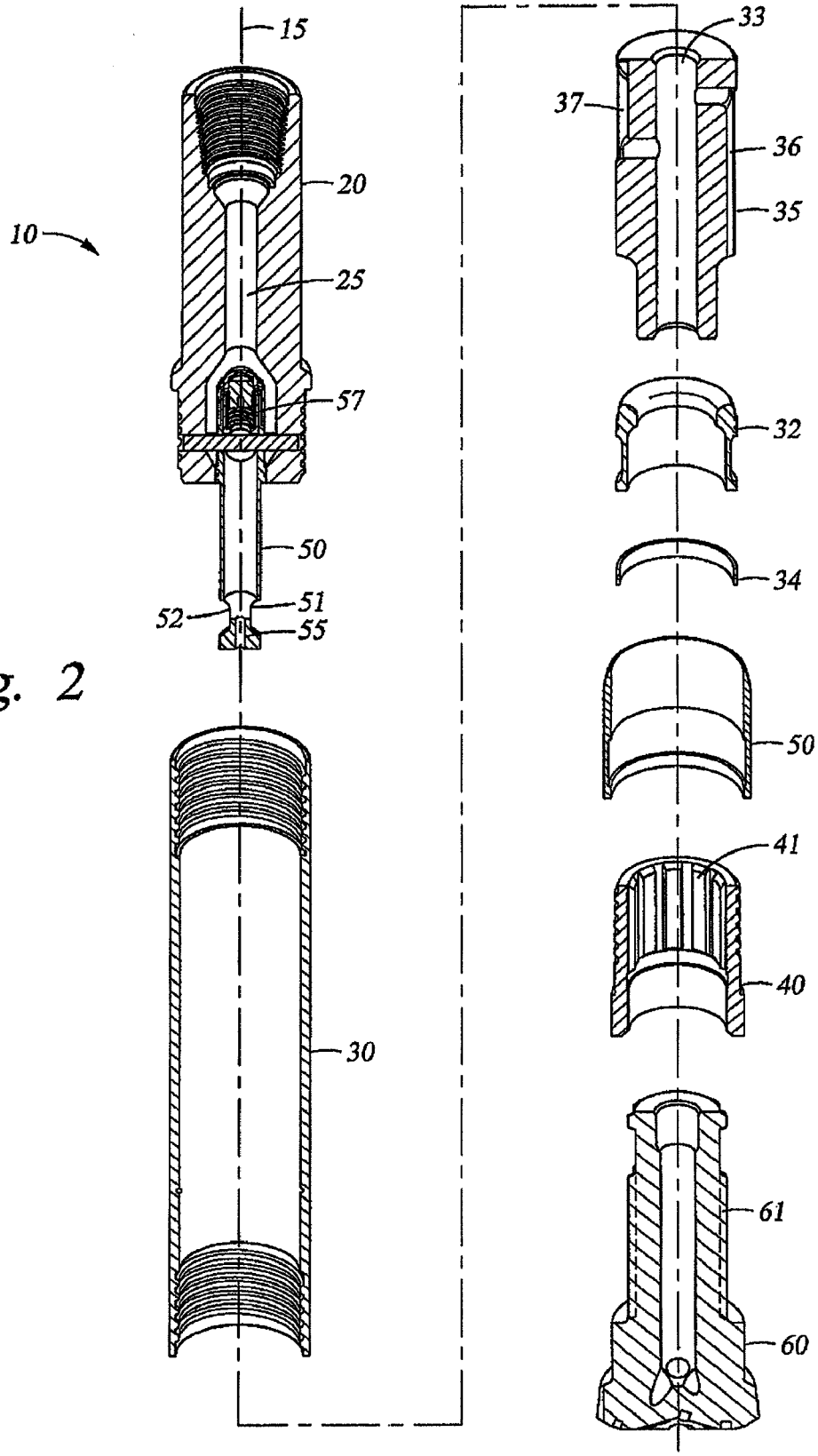
FIG. 2 is an exploded, cross-sectional view of the percussion drilling assembly of FIG. 1.

The following discussion is directed to various exemplary embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Referring now to FIGS. 1-6, a percussion drilling assembly 10 is shown, and includes an erosion retarding case 30 in accordance with the principles disclosed herein. Assembly 10 is connected to the lower end of a drillstring 11 (FIGS. 3 and 4) and includes a top sub 20, a driver sub 40, erosion retarding tubular case 30 axially disposed between top sub 20 and driver sub 40, a piston 35 slidably disposed in the tubular case 30, and a hammer bit 60 slidingly received by driver sub 40. A fluid conduit 50 extends between top sub 20 and piston 35. Top sub 20, case 30, piston 35, driver sub 40, fluid conduit 50, and hammer bit 60 are generally coaxially aligned, each sharing a common central or longitudinal axis 15. Similar to a typical feed tube hammer bit design, compressed fluid may flow through the inside of fluid conduit 50 and exit radially outward into ports in piston 35 to provide air to upper and lower piston-cylinder chambers that actuate piston 35. Consequently, fluid conduit 50 may also be referred to as a "feed tube". As is known in the art, percussion drilling assemblies may alternatively utilize an air distributor assembly, in which air is directed radially inward from an outer radial location into the upper and lower piston-cylinder chambers.

Figure 5:
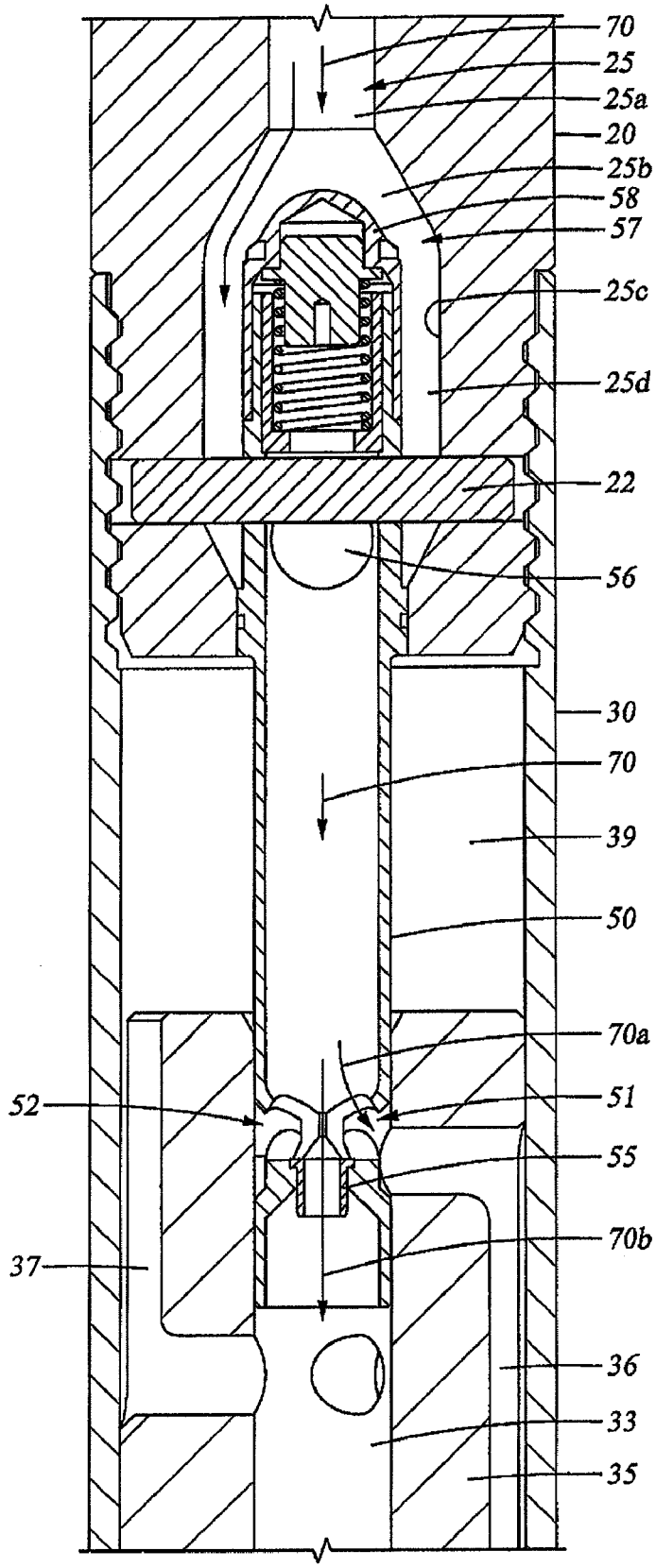
FIG. 5 is an enlarged partial cross-sectional view of the percussion drilling assembly of FIG. 1.

Top sub 20 is threadingly coupled between the lower end of drillstring 11 (FIG. 3) and the upper end of case 30. Top sub 20 includes a central through passage 25 in fluid communication with drillstring 11. As best shown in FIG. 5, passage 25 includes a generally uniform diameter upper section 25*a*, a lower enlarged diameter section 25*c*, and a generally frustoconical transition section 25*b* extending therebetween. The upper end of fluid conduit 50 is disposed in increased diameter section 25*c*, and coupled to top sub 20 with a pin 22 extending through top sub 20 and fluid conduit 50. The outer diameter of the fluid conduit 50 is less than the diameter of section 25*c*, and thus, an annulus 25*d* is formed between fluid conduit 50 and top sub 20.

Referring specifically to FIG. 5, a check valve 57 is coupled to the upper end of feed tube 50. Check valve 57 allows one-way fluid communication between upper section 25*a* and annulus 25*d*. In particular, check valve 57 includes a closure member 58 adapted to releasably and sealingly engage top sub 20 within transition section 25*b*. Accordingly, closure member 58 and check valve 57 may be described has having a "closed position" restricting fluid communication between upper section 25*a* and annulus 25*d* (i.e., with closure member 58 engaging top sub 20 within transition section 25*b*), and an "opened position" allowing fluid communication between upper section 25*a* and annulus 25*b* (i.e., with closure member 58 axially spaced apart from the surface of transition section 25*b*). Closure member 58 is axially biased to the closed position with a spring, but transitions to the opened position when the pressure differential between section 25*a* and annulus 25*d* is sufficient to overcome the biasing force.

Referring still to FIG. 5, the upper end of feed tube 50 disposed in increased diameter portion 25*c* also includes a plurality of radial inlet ports or apertures 56 that allow fluid communication between annulus 25*d* and feed tube 50. Thus, when check valve 57 is in the opened position, drillstring 11, upper section 25*a*, annulus 25*d*, inlet ports 56, and feed tube 50 are in fluid communication. However, when check valve 57 is in the closed position, fluid communication between upper section 25*a* and annulus 25*d*, ports 56, and feed tube 50 is restricted. In this manner, check valve 57 restricts the back flow of cuttings from the wellbore into drillstring 11. The lower end of feed tube 50 includes circumferentially spaced radial outlet ports 51, 52 and an axial bypass choke 55. As used herein the term "choke" may be used to refer to a flow passage that allows the working fluid (e.g., compressed air) to bypass the working section of the percussion drilling assembly (e.g., bypass the chambers that actual piston 35). In general, the smaller the choke diameter, the less bypassed working fluid, and the greater the pressure across the piston.

Figure 3:
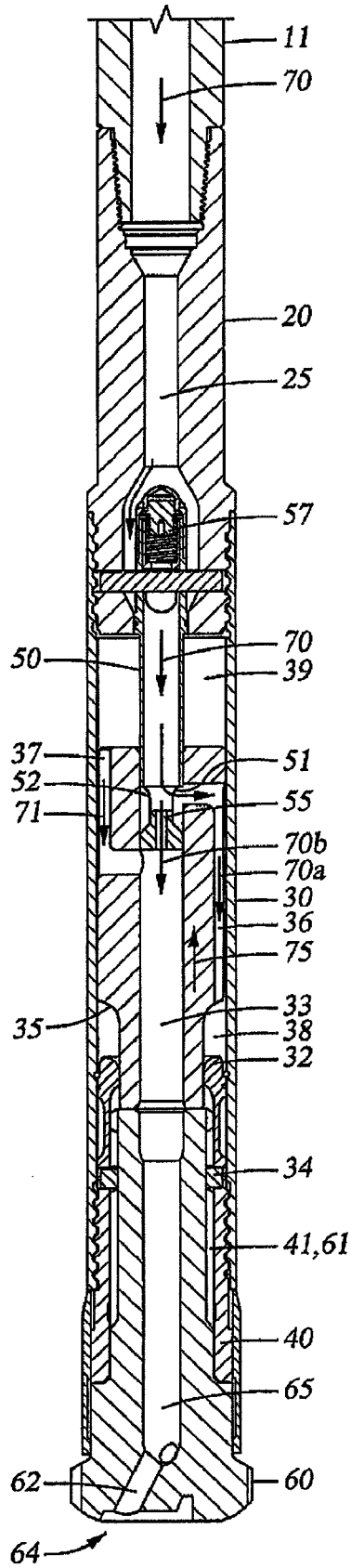
FIG. 3 is a cross-sectional view of the percussion drilling assembly of FIG. 1 connected to the lower end of a drillstring and with the piston in its lowermost position.
Figure 4:
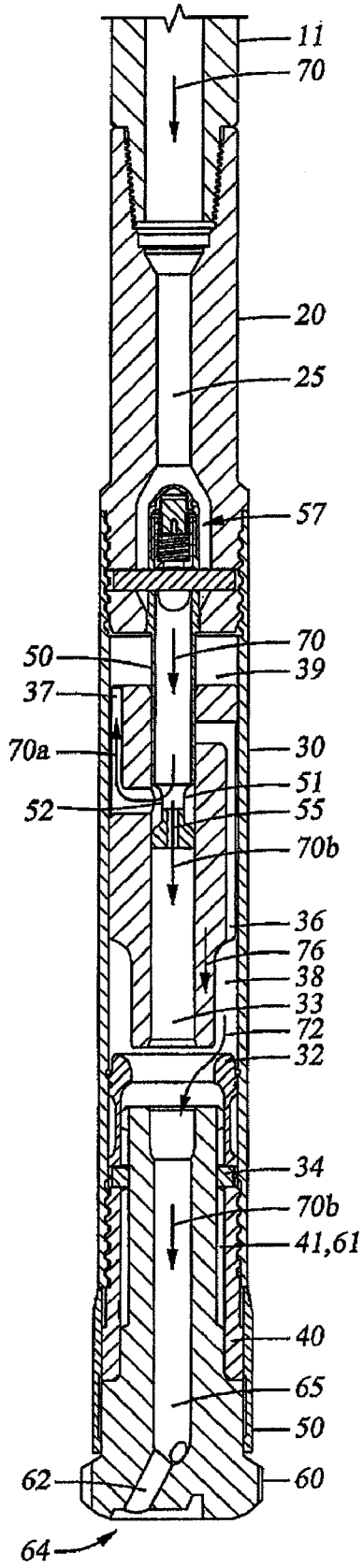
FIG. 4 is a cross-sectional view of the percussion drilling assembly of FIG. 1 connected to the lower end of a drillstring and with the piston in its uppermost position.

Referring now to FIGS. 3 and 4, the lower end of case 30 is threadingly coupled to the upper end of driver sub 40. Piston 35 is slidingly disposed in case 30 above hammer bit 60 and cyclically impacts hammer bit 60. The central through passage 33 in piston 35 slidingly receives the lower end of feed tube 50. Piston 35 also includes a first set of flow passage 36 extending from central passage 33 to a lower chamber 38, and a second set of flow passage 37 extending from central passage 33 to an upper chamber 39. Lower chamber 38 is defined by case 30, the lower end of piston 35, and guide sleeve 32, and upper chamber 39 is defined by case 30, the upper end of piston 35, and the lower end of top sub 20.

During drilling operations, piston 35 is reciprocally actuated within case 30 by alternating the flow of the compressed fluid (e.g., pressurized air) between passage 36, 37 and chambers 38, 39, respectively. More specifically, piston 35 has a first axial position with outlet port 51 is axially aligned with passage 36, thereby placing first outlet port 51 in fluid communication with passage 36 and chamber 38, and a second axial position with second outlet port 52 axially aligned passage 37, thereby placing second outlet port 52 in fluid communication with passage 37 and chamber 39. As the intersection of passages 33, 36 is axially spaced from the intersection of passages 33, 37, and thus, when first outlet port 51 is aligned with passage 36, second outlet port 52 is not aligned with passage 37 and vice versa. It should be appreciated that piston 35 assumes a plurality of axial positions between the first position and the second position, each allowing varying degrees of fluid communication between ports 51, 52 and passage 36, 37, respectively.

Guide sleeve 32 and a bit retainer ring 34 are also positioned in case 30 axially above driver sub 40. Guide sleeve 32 slidingly receives the lower end of pistol 35. Bit retainer ring 34 is disposed about the upper end of hammer bit 60 and prevents hammer bit 60 from completely disengaging assembly 10.

Hammer bit 60 slideably engages driver sub 40. A series of generally axial mating splines 61, 41 on bit 100 and driver sub 40, respectively, allow bit 60 to move axially relative to driver sub 40 while simultaneously allowing driver sub 40 to rotate bit 60 with drillstring 11 and case 30. A retainer sleeve 80 is coupled to driver sub 40 and extends along the outer periphery of hammer bit 60. As described in U.S. Pat. No. 5,065,827, which is hereby incorporated herein by reference in its entirety, the retainer sleeve 80 generally provides a secondary catch mechanism that allows the lower enlarged head of hammer bit 60 to be extracted from the wellbore in the event of a breakage of the enlarged bit head. Retainer sleeve 80 has an outer surface 82 defined by an outer diameter 86.

In addition, hammer bit 60 includes a central longitudinal passage 65 in fluid communication with downwardly extending passages 62 having ports or nozzles 64 formed in the face of hammer bit 60. Bit passage 65 is also in fluid communication with piston passage 33. Guide sleeve 32 maintains fluid communication between bores 33, 65 as piston 35 moves axially upward relative to hammer bit 60. Compressed fluid exhausted from chambers 38, 39 into piston passage 33 of piston 45 flows through bit passages 65, 62 and out ports or nozzles 64. Together, passages 62 and nozzles 64 serve to distribute compressed fluid around the face of bit 60 to flush away formation cuttings during drilling and to remove heat from bit 60.

Figure 6:
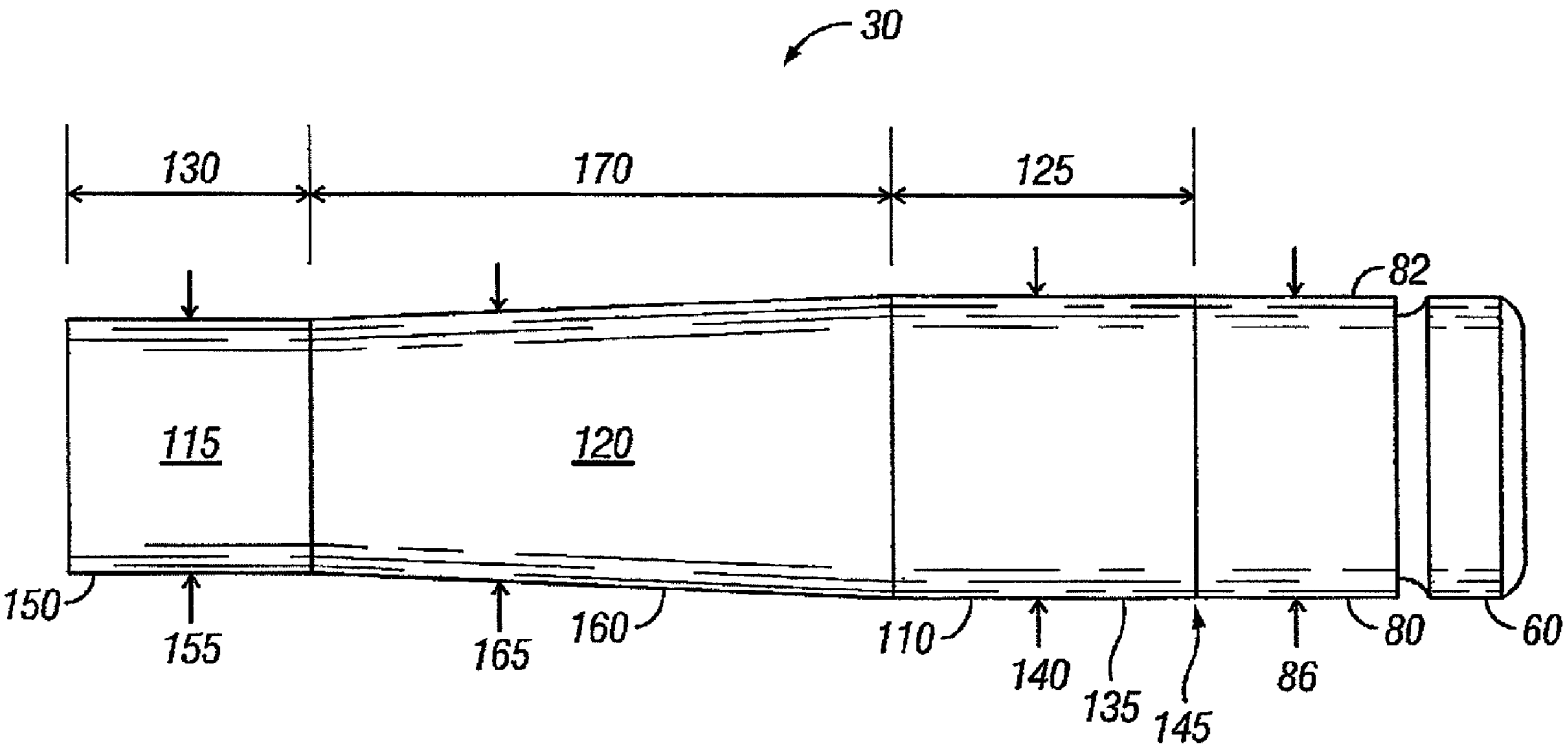
FIG. 6 is an enlarged side view of the erosion retarding case of FIG. 1.

Erosion retarding case 30, as shown in FIG. 6, includes a lower tubular portion or segment 110 abutting retainer sleeve 80, an upper tubular portion or segment 115 engaging top sub 20 (FIG. 3), and a middle tubular portion or segment 120 extending therebetween. Lower and upper portions 110, 115 have a length 125, 130, respectively, sufficient to enable gripping of case 30 over portions 110, 115 with tongs. In some embodiments, lengths 125, 130 of lower and upper portions 110, 115, respectively, are eight to twelve inches. Further, lower portion 110 of case 30 has an outer surface 135 defined by an outer diameter 140. At the interface 145 between case 30 and retainer sleeve 80, outer diameter 140 is substantially the same as outer diameter 86. Thus, there is no geometric discontinuity along percussion drilling assembly 10 at the transition between case 30 and retainer sleeve 80, the benefit of which is described below.

Upper portion 115 of case 30 has an outer surface 150 defined by an outer diameter 155. Middle portion 120 has an outer surface 160 defined by an outer diameter 165 that varies along its length 170, enabling outer surface 160 to provide a smooth transition free of sharp geometric changes and discontinuities between lower portion 110 and upper portion 115. In some embodiments, length 170 of middle portion 120 is 10 to 44 inches. At the lower end 175 of middle portion 120, outer diameter 165 is equal to outer diameter 140 of lower portion 110. At the upper end 180 of middle portion 120, outer diameter 165 is equal to outer diameter 155 of upper portion 115. In some embodiments, including those depicted by FIG. 6, outer diameter 155 of upper portion 115 is less than outer diameter 140 of lower portion 110. Thus, middle portion 120 tapers from larger diameter lower end 175 to smaller diameter upper end 180, as shown. Between upper and lower ends 180, 175, respectively, outer diameter 165 varies. In some embodiments, including those illustrated by FIG. 6, outer diameter 165 varies linearly between upper and lower ends 180, 175.

Referring now to FIGS. 3-6, during drilling operations, a compressed fluid (e.g., compressed air, compressed nitrogen, etc.) is delivered down the drill string 11 from the surface in the direction of arrow 70. In most cases, the compressed fluid is provided by one or more compressors at the surface. The compressed fluid flows down drill string 11 into upper section 25*a* of passage 25. With a sufficient pressure differential across check valve 57, closure member 58 will remain in the opened position allowing the compressed fluid to flow through annulus 25*d*, inlet ports 56, and down feed tube 50 to outlet ports 51, 52 and choke 55. The flow of compressed fluid is divided between ports 51, 52 and choke 55; a first fraction of the compressed fluid flows radially outward through ports 51 and/or 52 as represented by arrow 70*a*, and a second fraction of the compressed fluid flows through choke 55 into a central piston passage 33 as represented by arrow 70*b*. In general, the first fraction of the compressed fluid flowing through outlet ports 51, 52 serves to cyclically actuate piston 35, whereas the second fraction of the compressed fluid flowing through choke 55 flows through passages 33, 65, 62 and exits hammer bit 60 via ports 64, thereby flushing cutting from the face of bit 60. Since the flow of compressed fluid through outlet ports 51, 52 actuates piston 35, outlet ports 51, 52 may also be referred to as "piston actuation" ports.

At the same time, drill string 11 and drilling assembly 10 are rotated. Mating splines 161, 41 on bit 100 and driver sub 40, respectively, allow bit 100 to move axially relative to driver sub 40 while simultaneously allowing driver sub 40 to rotate bit 100 with drillstring 11. The rotation of hammer bit 60 allows the cutting elements (not shown) of bit 100 to be "indexed" to fresh rock formations during each impact of bit 100, thereby improving the efficiency of the drilling operation.

Compressed fluid exiting hammer bit 60 through ports 64 flows upward from the base of the borehole through the annulus between drilling assembly 10 and the borehole sidewall to the surface. Due to the absence of a geometric discontinuity at interface 145 between case 30 and retainer sleeve 80, as well as the smooth transitions between outer surfaces 135, 160, 150 of case 30, case 30 is free of structural features that may disturb the surrounding fluid flow, thereby promoting localized turbulence. Turbulence caused by such geometric discontinuities in combination with the abrasive nature of formation chips suspended in the fluid increase the rate of erosion experienced by case 30, particular over lower portion 110, as illustrated below.

Figure 7:
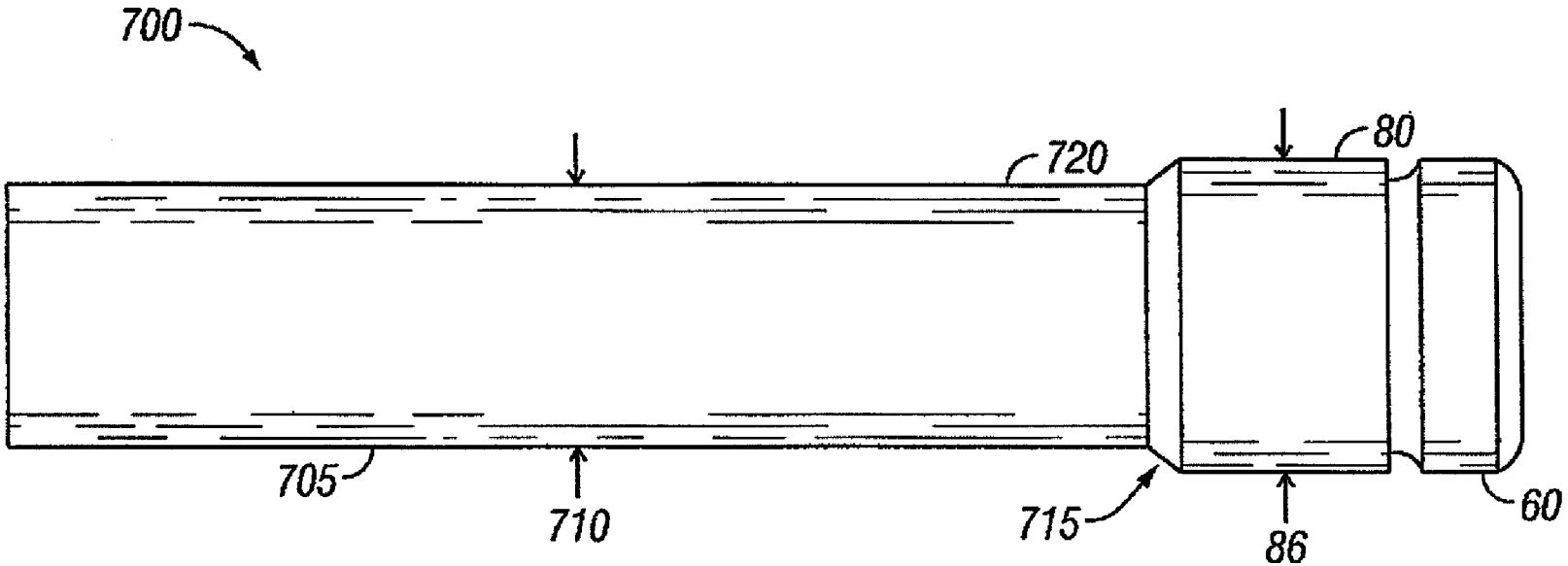
FIG. 7 (Prior Art)
FIG. 7 is an enlarged side view of the lower end of a conventional case and bit retainer.
Figure 8:
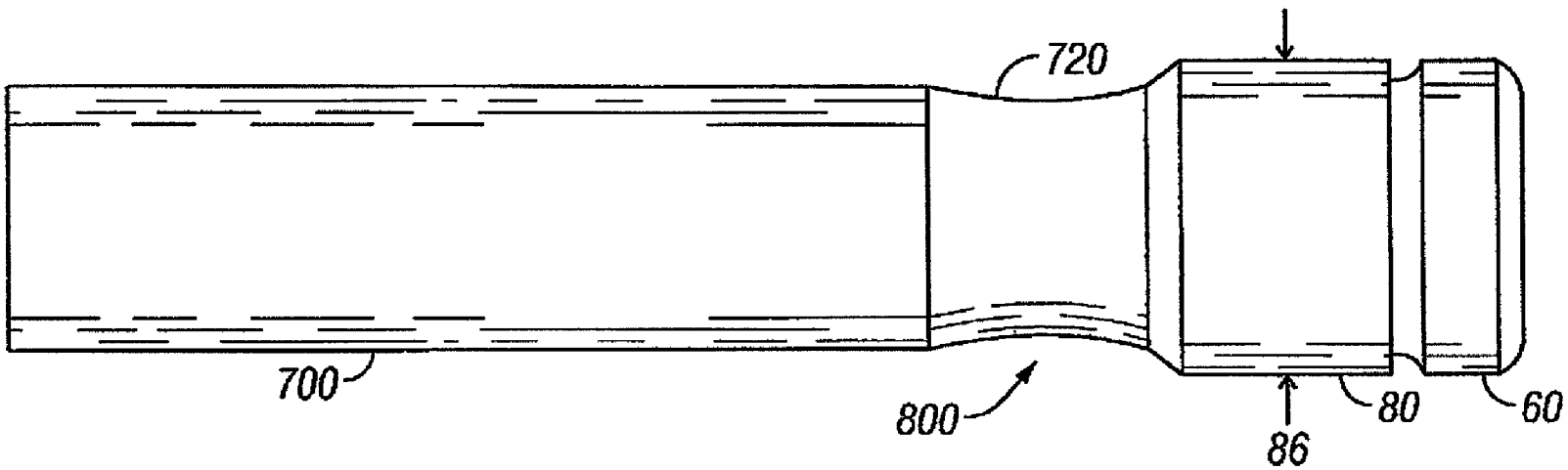
FIG. 8 (Prior Art)
FIG. 8 is an enlarged side view of the lower end of the case of FIG. 7 following erosion.

Referring to FIG. 7, a conventional case 700 is shown in engagement with retainer sleeve 80 and hammer bit 60. Conventional case 700 has an outer surface 705 defined by a constant outer diameter 710 that is less than outer diameter 86 of retainer sleeve 80. Thus, there is a geometric discontinuity 715 at the transition between case 700 and retainer sleeve 80. During operation of a percussion drilling assembly including case 700, geometric discontinuity 715 promotes localized turbulent fluid flow proximate the lower end 720 of case 700. The combined effect of the turbulent fluid flow and the abrasive nature of formation chips suspended in the fluid cause erosion 800 of case 700 at its lower end 720, as illustrated by FIG. 8. Erosion 800 of conventional case 700 in this manner weakens case 700 and hastens the need for replacement of case 700.

Disclosed are embodiments directed to a case that is erosion retardant, or in other words, configured to reduce the turbulence of fluid flow proximate its lower end. Referring again to FIG. 6, the lack of a geometric discontinuity at interface 145 between case 30 and retainer sleeve 80 and the smooth transition of outer surfaces 135, 160, 150 along case 30 minimize any disturbance of case 30 to the surrounding fluid flow that may promote turbulence. Thus, case 30 may be considered erosion retarding.

Figure 9:
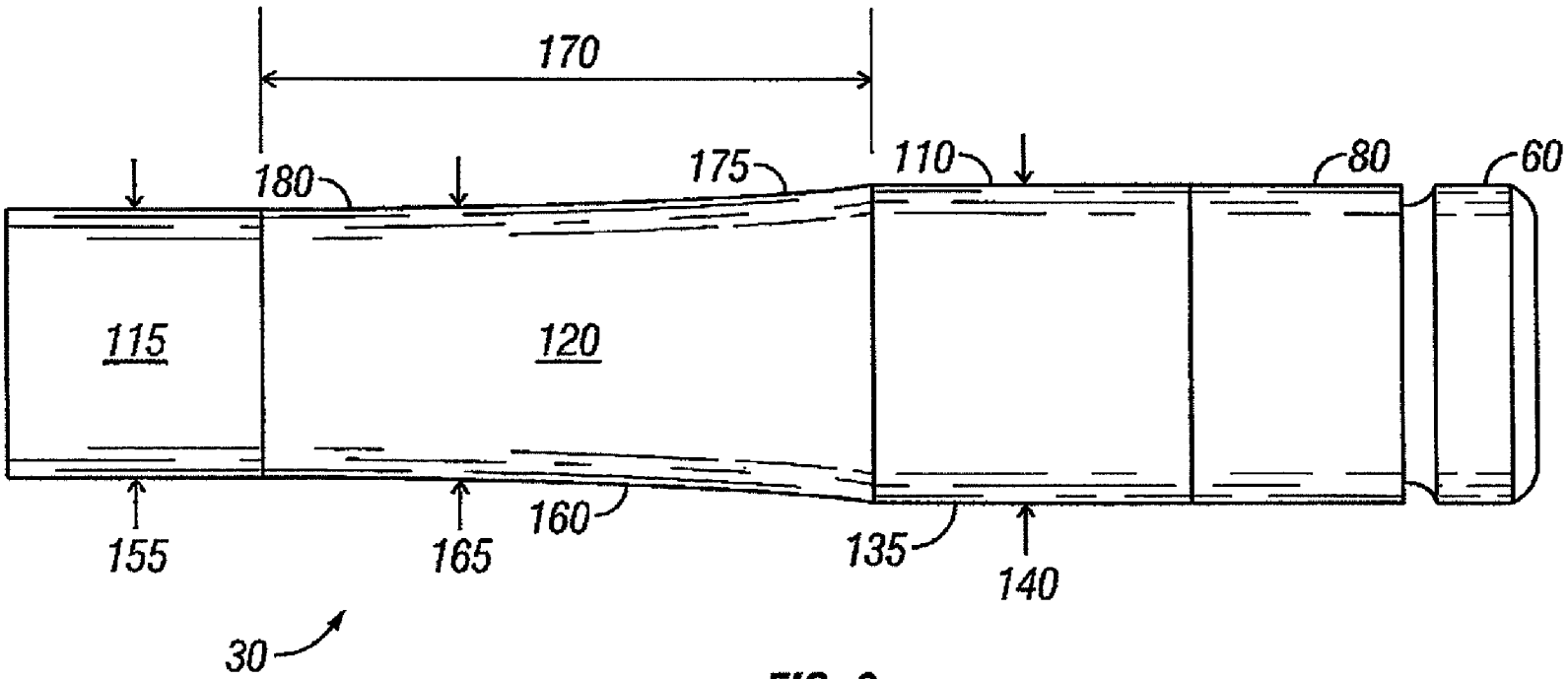
FIG. 9 is an enlarged side view of an erosion retarding case having a curvilinear outer surface which tapers from its lower end to its upper end.

Still referring to FIG. 6, in this exemplary embodiment, outer diameter 165 of case 30 varies linearly between ends 175, 180 of middle portion 120. In other embodiments, however, outer diameter 165 may vary nonlinearly between ends 175, 180. In such embodiments, illustrated by FIG. 9, erosion retarding case 30 has an outer surface 160 that is curvilinear, having, as one example, an exponential shape.

Figure 10:
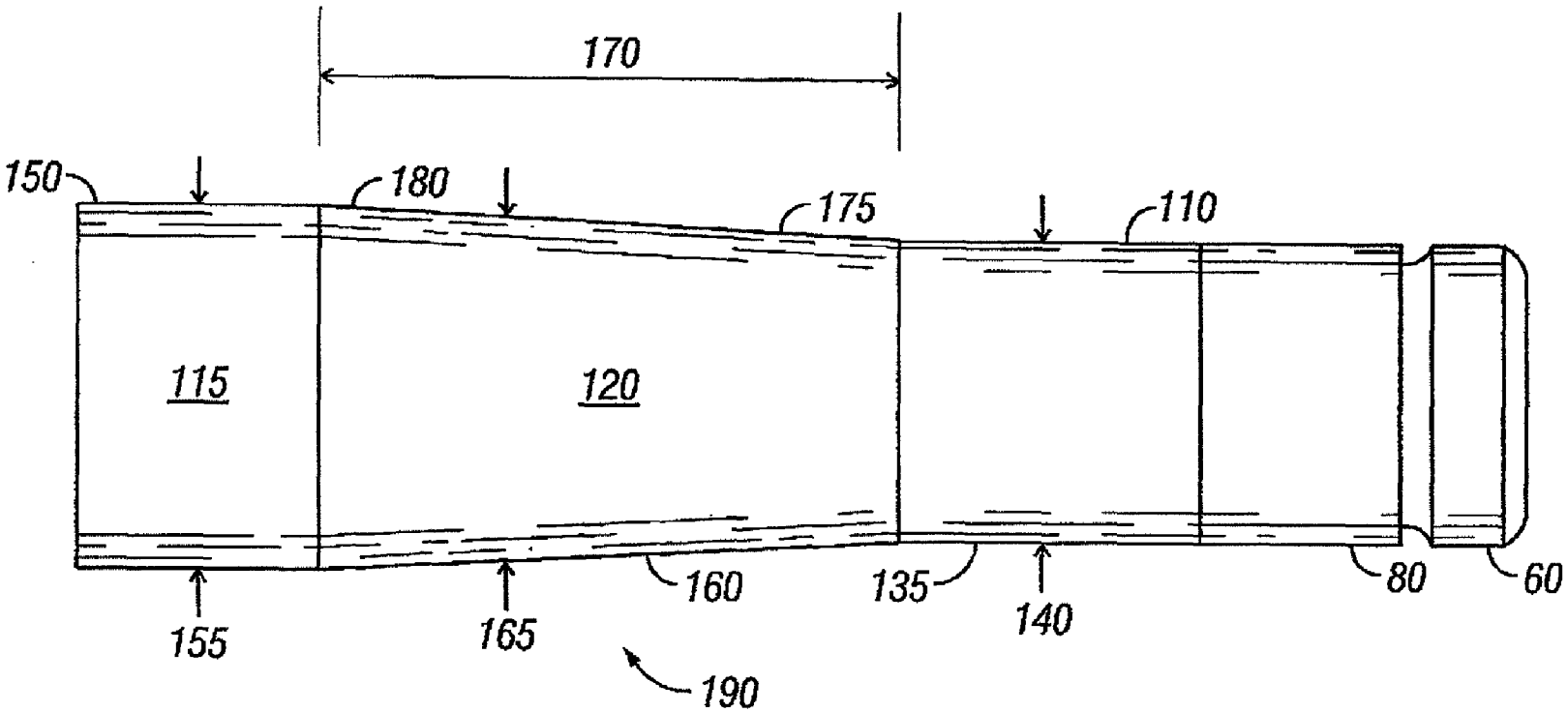
FIG. 10 is an enlarged side view of an erosion retarding case having a linear outer surface which tapers from its upper end to its lower end.
Figure 11:
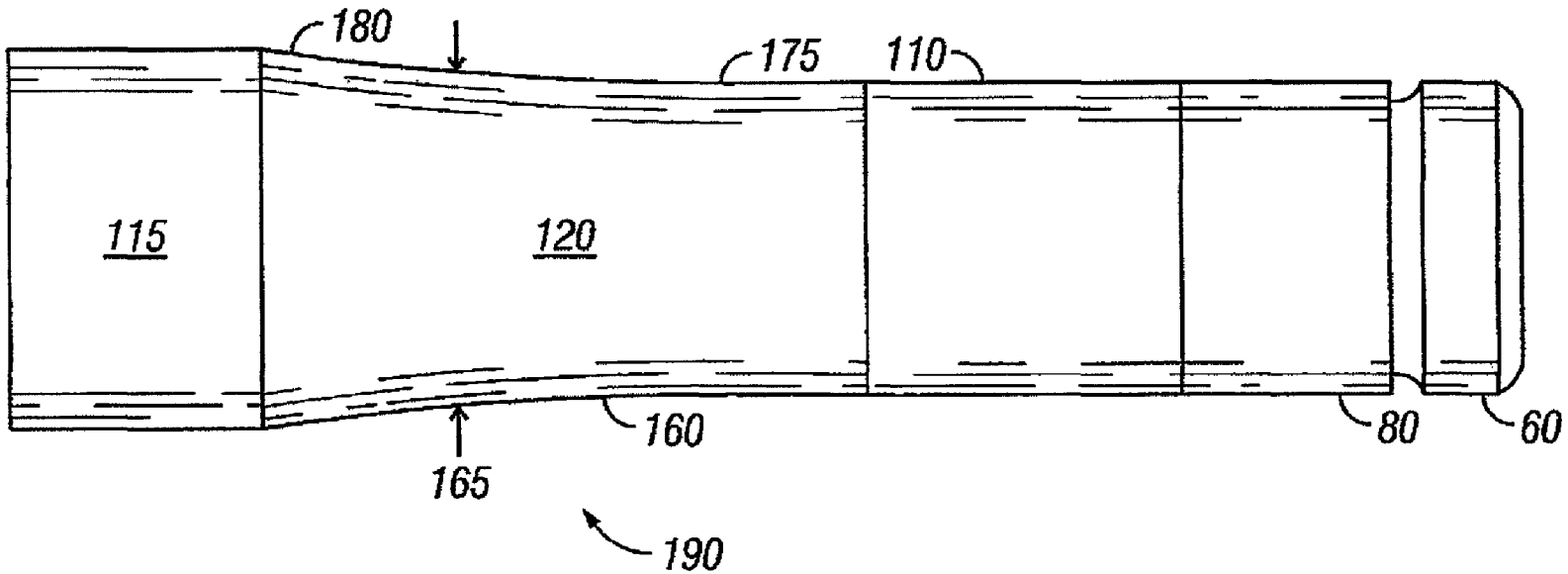
FIG. 11 is an enlarged side view of an erosion retarding case having a curvilinear outer surface which tapers from its upper end to its lower end.

Turning next to FIG. 10, an erosion retarding case 190 is shown, wherein outer diameter 155 of upper portion 115 is greater than outer diameter 140 of lower portion 110. To minimize turbulence surrounding case 190, middle portion 120 has an outer surface 160 defined by an outer diameter 165 that varies along its length 170, enabling outer surface 160 to provide a smooth transition free of geometric discontinuities between lower portion 110 and upper portion 115. At the lower end 175 of middle portion 120, outer diameter 165 is equal to outer diameter 140 of lower portion 110. At the upper end 180 of middle portion 120, outer diameter 165 is equal to outer diameter 155 of upper portion 115. Thus, middle portion 120 tapers from larger diameter upper end 180 to smaller diameter lower end 175. Between upper and lower ends 180, 175, respectively, outer diameter 165 varies. In some embodiments, including those illustrated by FIG. 10, outer diameter 165 varies linearly between upper and lower ends 180, 175. Alternatively, in some embodiments, outer diameter 165 of middle portion 120 varies nonlinearly between ends 175, 180, as illustrated by FIG. 11. In such embodiments, outer surface 160 is curvilinear, having, as one example, an exponential shape.

Figure 12:
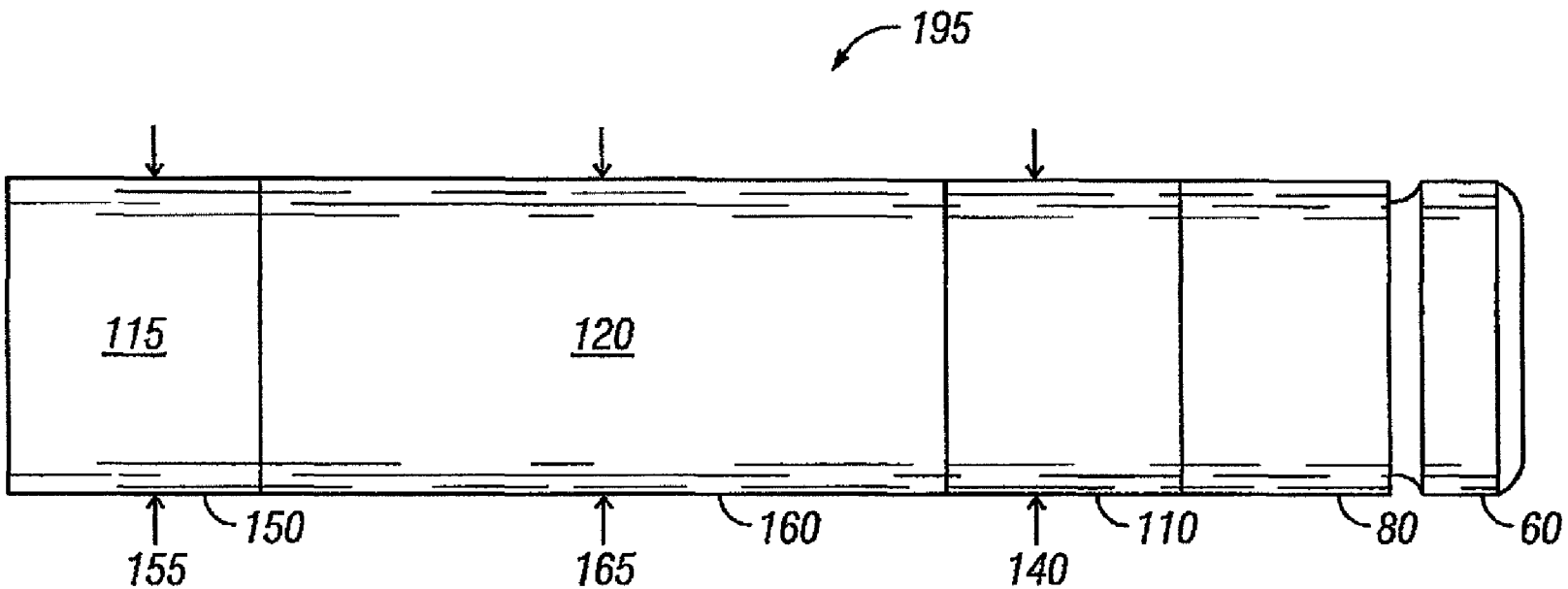
FIG. 12 is an enlarged side view of a straight, erosion retarding case.

Turning next to FIG. 12, an erosion retarding case 195 is shown, wherein outer diameter 155 of upper portion 115 is substantially equal to outer diameter 140 of lower portion 110. To minimize turbulence surrounding case 195, middle portion 120 has an outer surface 160 defined by a constant outer diameter 165 that is equal to outer diameters 140, 155. Thus, middle portion 120 is straight and free of geometric discontinuities.

To further minimize the turbulence of fluid flow surrounding any one or all of cases 30, 190, 195, one or more of outer surfaces 135, 160, 150 of cases 30, 190, 195 may be textured, similar to the dimpled surface of a golf ball, through a manufacturing process, such as but not limited to machining or casting. Texturing, meaning forming one or more recesses by machining or other equivalent method, of outer surfaces 135, 160, 150 delays separation of the boundary layer from case 30, 190, 195 as fluid flows over surfaces 135, 160, 150. Early separation, such as that occurring in the absence of texturing, promotes turbulence of fluid surrounding case 30, 190, 195. Thus, to prevent early separation of the boundary layer from case 105 and thus to minimize turbulence surrounding case 30, 190, 195, one or more surfaces 135, 160, 150 of case 30, 190, 195 may be textured.

Figure 13:
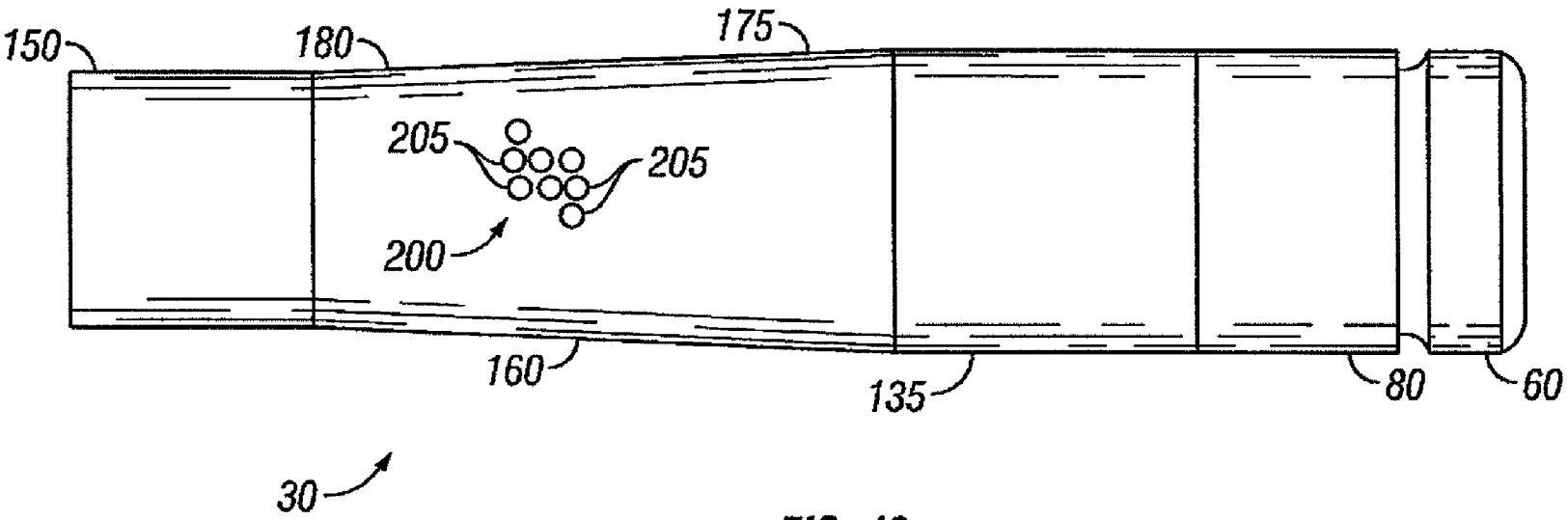
FIG. 13 is an enlarged side view of a textured erosion retarding case.

In some embodiments, illustrated by FIG. 13, texturing 200 of case 30, 190, 195 includes a plurality of recesses or dimples 205 formed in one or more surfaces 135, 160, 150. The size and/or depth of dimples 205 may vary over surfaces 135, 160, 150 or be uniform throughout. Further, dimples 205 may circular in shape or have a noncircular cross-section. Dimples 205 may be arranged randomly over surfaces 135, 160, 150 or be formed in a pattern, also similar to a golf ball.

Whether tapered or straight, textured or not, case 30, 190, 195 is configured to minimize geometric discontinuities between its outer surfaces 135, 160, 150 and at its interfaces with retainer sleeve 80 and top sub 20. By minimizing the turbulence of fluid flow surrounding case 30, 190, 195, erosion of case 30, 190, 195 caused by contact with chips of formation material may be slowed, prolonging the life of case 30, 190, 195 and postponing the need for its replacement.

While various preferred embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A percussion drilling assembly for drilling through earthen formations and forming a borehole, the assembly comprising:

a percussion drill bit;

a retainer sleeve having an upper end with an outer diameter; and a tubular casing engaging the retainer sleeve, the tubular casing comprising:

a first tubular portion engaging the upper end of the retainer sleeve at a first end having an outer diameter substantially equal to the outer diameter of the retainer sleeve;

a second tubular portion connected to the first tubular portion at a first end and having a second end with an outer diameter that differs from the outer diameter of the retainer sleeve;

a third tubular portion coupled to the second tubular portion, wherein the first tubular portion and the third tubular portion each have a length configured to enable gripping of the tubular casing over at least one of the first tubular portion and the third tubular portion using tongs; and a plurality of dimples arranged on an outer surface of at least one of the first, second, and third tubular portions of the tubular casing, wherein the dimples comprise a hemispherical surface and alter a flow behavior of fluid passing along the dimples during drilling.

2. The percussion drilling assembly of claim 1, wherein the outer diameter of the second end of the second tubular portion is less than the outer diameter of the first tubular portion.

3. The percussion drilling assembly of claim 2, wherein the second tubular portion comprises an outer surface disposed between the first and second ends of the second tubular portion, the outer surface defined by an outer diameter that varies.

4. The percussion drilling assembly of claim 3, wherein the outer diameter of the outer surface varies linearly.

5. The percussion drilling assembly of claim 3, wherein the outer surface is curvilinear.

6. The percussion drilling assembly of claim 1, wherein the outer diameter of the second end of the second tubular portion is greater than the outer diameter of the first tubular portion.

7. The percussion drilling assembly of claim 6, wherein the second tubular portion comprises an outer surface disposed between the first and second ends of the second tubular portion, the outer surface defined by an outer diameter that varies.

8. The percussion drilling assembly of claim 7, wherein the outer diameter of the outer surface varies linearly.

9. The percussion drilling assembly of claim 7, wherein the outer surface is curvilinear.

10. The percussion drilling assembly of claim 1, wherein the second tubular segment has an outer surface with a constant outer diameter.

11. A percussion drilling assembly for drilling through earthen formations and forming a borehole, the assembly comprising:

a percussion drill bit;

a retainer sleeve having an upper end with an outer diameter; and a tubular casing engaging the retainer sleeve, the tubular casing comprising:

a first tubular segment engaging the upper end of the retainer sleeve at a first end having an outer diameter substantially equal to the outer diameter of the retainer sleeve;

a second tubular segment connected to the first tubular segment at a first end and having a second end;

a third tubular segment connected to the second end of the second tubular segment; and a plurality of dimples arranged on an outer surface of at least one of the first, second, and third tubular segments of the tubular casing, wherein the dimples comprise a hemispherical surface and alter a flow behavior of fluid passing along the dimples during drilling.

12. The percussion drilling assembly of claim 11, wherein the first tubular segment and the third tubular segment each have a length configured to enable gripping of the tubular casing over at least one of the first tubular segment and the third tubular segment using tongs.

13. The percussion drilling assembly of claim 11, wherein the third tubular segment has an outer diameter that differs from the outer diameter of the first tubular segment and the second tubular segment has a tapered outer surface.

14. The percussion drilling assembly of claim 13, wherein the tapered outer surface of the second tubular segment is linear.

15. The percussion drilling assembly of claim 13, wherein the tapered outer surface of the second tubular portion is curvilinear.

16. A percussion drilling assembly for drilling through earthen formations and forming a borehole, the assembly comprising:

a percussion drill bit;

a retainer sleeve having an upper end with an outer diameter; and a tubular casing engaging the retainer sleeve, the tubular casing comprising:

a first tubular segment engaging the upper end of the retainer sleeve at a first end having an outer diameter substantially equal to the outer diameter of the retainer sleeve;

a second tubular segment connected to the first tubular segment at a first end and having a second end;

a third tubular segment connected to the second end of the second tubular segment; and a plurality of dimples arranged on an outer surface of at least one of the first, second, and third tubular segments of the tubular casing, wherein the plurality of dimples are free of elements mounted therein and alter a flow behavior of fluid passing along the dimples during drilling.

17. The percussion drilling assembly of claim 16, wherein the outer diameter of the second end of the second tubular portion is less than the outer diameter of the first tubular portion.

18. The percussion drilling assembly of claim 17, wherein the second tubular portion comprises an outer surface disposed between the first and second ends of the second tubular portion, the outer surface defined by an outer diameter that varies.

19. The percussion drilling assembly of claim 18, wherein the outer diameter of the outer surface varies linearly.

* * * * *